United States Patent [19]

Skopp et al.

[11] 4,385,970

[45] May 31, 1983

[54] SPONTANEOUS DEPOSITION OF METALS USING FUEL FED CATALYTIC ELECTRODE

[75] Inventors: Alvin Skopp, Scotch Plains; George Ciprios, Freehold; John S. Batzold, Union, all of N.J.

[73] Assignee: Exxon Research and Engineering Co., Florham Park, N.J.

[21] Appl. No.: 196,475

[22] Filed: Oct. 14, 1980

[51] Int. Cl.[3] ..... C25B 11/03; C25B 11/04; C25B 11/06; C25C 1/12

[52] U.S. Cl. ..... 204/108; 204/294; 204/295; 204/296; 204/291; 204/292; 204/DIG. 4

[58] Field of Search ..... 201/DIG. 3–DIG. 4, 201/294, 295, 296, 291, 292, 282–283, 105 R, 106–108, 109, 111, 114, 117, 119, 284

[56] References Cited

U.S. PATENT DOCUMENTS 4,035,254 7/1977 Gritzner ..... 204/128
4,260,469 4/1981 McIntyre et al. ..... 204/265

OTHER PUBLICATIONS

PCT WO81/01159, "Process and Apparatus for Producing Metals at Porous Hydrophobic Catalytic Barriers" by Judd et al., 10-26-79.

*Primary Examiner*—R. L. Andrews
*Attorney, Agent, or Firm*—Joseph J. Dvorak

[57] ABSTRACT

The present invention encompasses the use of a specific fuel fed electrode in depositing metals from solutions thereof and in the absence of an external applied potential. Basically as shown in FIG. 1, the electrode comprises an electrically conductive porous substrate 3 bearing on one surface thereof a fuel activating catalyst 4. The porosity of the substrate is sufficient that the current density at surface 2 of the substrate 3 opposite the catalyst 4 will assure substantially complete depletion of metal ions very near the surface of the porous substrate, whereby the catalyst surface and the pores remain substantially free of deposited metal.

9 Claims, 4 Drawing Figures

SPONTANEOUS DEPOSITION OF METALS USING FUEL FED CATALYTIC ELECTRODE

FIELD OF THE INVENTION

This invention relates to the recovery of metals from solutions thereof. More particularly, the invention is concerned with electrodes for recovering metals by spontaneous deposition of the metals from acidic solutions thereof wherein the electrochemical reaction resulting in metal deposition is effected at the surface of a fuel fed electrode structure and in the absence of an externally applied electric potential.

DESCRIPTION OF THE PRIOR ART

The electrolytic deposition of metals from acidic solutions containing the metal is a well-known commercial process. In general, the acidic solutions employed in such processes are obtained by treating ores or ore concentrates with acidic leaching solutions, usually sulfuric acid, and the leach liquor is then electrolyzed within an appropriate electrochemical cell. During the electrolysis of the leach liquor, large amounts of oxygen are evolved at the anode necessitating the employment of high input voltages to overcome the oxygen over voltage and the cell resistance losses, thereby detrimentally affecting the economics of such electrolytic processes.

In order to effect a savings in energy consumption in such electrolytic processes, it has been proposed to equip the electrolytic cell with the fuel fed porous catalytic electrode. Illustrative of such processes are those disclosed in U.S. Pat. Nos. 3,103,473 and 3,103,474. One of the disadvantages associated with such a process is that, with some metals, deposition on the catalyst of the metal being electroplated deactivates the anode catalyst. Moreover, the deposition of a coherent film of the metal being electroplated effectively prevents the flow of electrolyte through the anode, thereby terminating the electrochemical process.

In U.S. Pat. No. 3,793,165, it is proposed to employ a diffusion barrier separating a fuel fed anode from a cathode and passing a metal free solution to the anode compartment so that the fuel fed anode is operated in a metal-free solution and the cathode is operated in a metal containing solution. An external electric path is provided between the separated anode and cathode for completing the cell circuit. This technique, however, requires large volumes of metal-free sulfuric acid and auxiliary equipment for maintaining positive flow of the solution; and, the barrier still has the potential for being plugged by the metal being electroplated from the acidic solution.

SUMMARY OF THE INVENTION

The present invention encompasses the use of a specific fuel fed electrode in depositing metals from acidic solutions thereof. Basically, the electrode comprises an electrically conductive porous substrate bearing on one surface thereof the fuel activating catalyst. The porosity of the electrically conducting substrate is sufficient that the current density at the surface of the substrate opposite that bearing the catalytic member is sufficiently high so as to completely deplete the metal ions being electroplated very near the surface of the porous substrate.

The invention summarized hereinabove including all the embodiments stemming therefrom will become readily apparent upon reading of the detailed description which follows in conjunction with the drawings.

DETAILED DESCRIPTION OF THE DRAWINGS

DETAILED DESCRIPTION OF THE INVENTION

Figure 1:
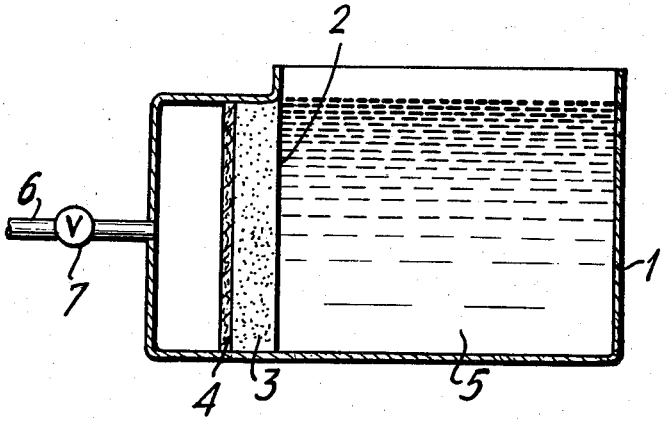
FIG. 1 is a diagrammatic illustration of an electrochemical cell having an anode assembly in accordance with the present invention.

Referring first to FIG. 1, there is shown a cell for the electrodeposition of a metal of oxidation potential below that of hydrogen. The cell includes a tank 1 and a fuel fed catalytic electrode made up of a porous electrically conductive substrate 3 having a catalyst 4 deposited on one surface of the anode, the opposite surface 2 of the porous conductive substrate being in contact with the metal containing electrolyte 5. Inlet 6 and valve 7 are provided for controlling the flow of fuel to the catalytic side of the porous electrode.

The fuel fed electrode substrate of this invention may be prepared from any electrically conducting material which is stable in acidic solutions at the hydrogen potential. Typical of such materials include copper, tantalum, porous carbon and carbon fibers.

As stated previously, the porous substrate 3 has on one surface thereof a metal catalyst for promoting catalytic oxidation of the fuel feed; and consequently, the surface of the substrate with catalyst 4 serves as an anode. Typical catalysts for use in the present invention include the precious metal catalysts, such as rhodium, platinum, palladium and iridium and alloys and mixtures thereof. The catalyst may be deposited directly on the porous substrate 3 of the electrode. Optionally and preferably, however, the metal catalyst is supported on graphitized carbon powder. Thereafter, the metal impregnated carbon is dispersed in a polymeric material, such as polytetrafluroethylene and this porous plastic member is thermally bonded to the porous substrate 3 of the electrode.

Figure 2:
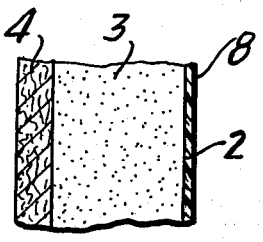
FIG. 2 is a diagrammatic cross-section of an electrode in accordance with the present invention.

In an alternate embodiment of the invention shown in FIG. 2, the porous electrode is also provided with a thin porous film 8 of plastic material or an appropriate release agent such as a Teflon spray or other mold release agent to minimize the amount of metal which will adhere firmly to the cathodic surface 2 of the electrode substrate 3.

Figure 3:
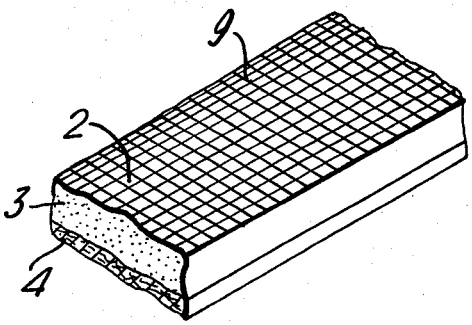
FIG. 3 is an illustration partly in perspective of an alternate embodiment of an electrode in accordance with the present invention.

In yet another embodiment for the present invention, shown in FIG. 3, the substrate 3 is provided with a polymeric mesh 9 on cathodic surface 2 which can be peeled away from the substrate 3 after the deposition of metal thereby facilitating the ease with which the electrode is stripped of deposited metal. This plastic mesh can be made from any suitable material which will be stable under conditions of use, such as polyethylene, polypropylene, Dynel, and the like. The mesh can be woven or non-woven.

In the foregoing embodiments, the porous electrically conductive substrate 3 will have a porosity sufficient to prevent deposition of metal on the catalyst at the anodic or catalytic surface of the electrode. Stated differently, the porosity must be such that, in use, the current density is high enough to deplete the metal ions in the electrolyte very near the cathodic surface 2 of the porous substrate so that all deposition takes place external to the porous substrate. The precise porosity of the electrode substrate 3 may vary depending upon the particular metal to be deposited and its concentration in the solution. As a guide, however, the porosity generally will be in the range of from about 50% to 90% and preferably in the range of 70% to 85% with pore sizes ranging from about 1 to about 100 microns in diameter and preferably ranging from about 10 to about 50 microns in diameter.

The metals which may be deposited from solution according to this invention are those whose oxidation potential is below hydrogen, or stated differently, whose electrode potentials are positive with respect to hydrogen by the Gibbs-Stockholm convention. Examples of these include copper, silver, mercury and the noble metals.

It should be readily appreciated that there are a wide variety of fuels also suitable in conjunction with use of the fuel fed electrode of the present invention. Basically, the fuel used will be one which is capable of hydrogen ion production, and consequently, the materials such as hydrogen gas or hydrogen-containing gases, reformed natural gas, and partially oxidized natural gas will be useful. Other reducing gases, however, may also be employed, such as carbon monoxide, since at the anode surface of the electrode hydrogen ion is produced therefrom in the acidic medium employed in recovering metals from solution.

As indicated hereinabove, a wide variety of metals may be recovered from solution in accordance with the practice of the present invention. For purposes, however, of illustrating the significance of the present invention, reference is made hereinafter specifically to the deposition of copper from a copper salt solution, such as copper sulfate. Thus, for example, as is shown in FIG. 1, a cell is charged with a copper sulfate solution 5 having a pH of about 1 to about 3. A hydrogen-containing gas is introduced via inlet 6 through valve 7 and thence to the porous interface-maintaining catalytic electrode. The hydrogen-containing gas first contacts the catalytic surface 4, reacting to form hydrogen ions and electrons. The hydrogen ions diffuse through the electrolyte filled pores of the conductive porous layer to the bulk electrolyte. Since the rate of production of electrons is greater than the diffusion of ions into the structure, under steady state conditions, the electrons are conducted to the cathodic surface 2 of the porous structure where the electrons combine with the copper ions resulting thereby in the deposition on the surface of copper metal. After sufficient deposition of the copper, the metal is removed from the electrode by a suitable stripping technique.

In those instances where an anode, such as that described in conjunction with FIG. 3 is employed, the copper is very readily removed by peeling away the polymeric mesh material.

It should be readily appreciated that the foregoing description has been in conjunction with the batch process; however, the metal deposition process can be conducted in a continuous manner. Indeed, in accordance with the practice of the present invention, a fuel fed electrode can be prepared in the form, for example, of a continuous belt, which can be passed through a reaction zone in contact with fuel gas and metal solution, and thus subsequently into a recovery zone where the metal is stripped off.

In order that those skilled in the art may more readily understand the present invention, the following specific examples are provided.

EXAMPLES

EXAMPLE 1

Figure 4:
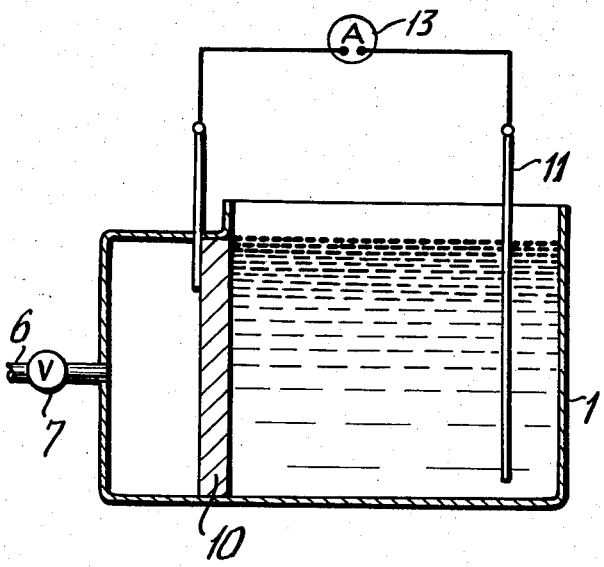
FIG. 4 is an illustration of a cell used in demonstrating the deposition of copper in accordance with the present invention.

In this example, an electrochemical cell was provided as shown in FIG. 4 with a fuel fed electrode 10 and an auxillary cathode 11. The cathode 11 was used solely to permit measurement by meter 13 of the maintenance of activity of the anodic surface of the electrode 10 with time. The fuel fed porous electrode 10 was prepared from a nickel substrate, having a porosity of 75% and pores ranging from 1 to 100 microns in diameter. Nickel was employed as a matter of convenience. Since nickel is not stable over extended time periods, nickel is not the material of choice in the practice of this invention. In any event, on one surface of the nickel substrate was bonded a porous layer of polytetrafluoroethylene and platinum metal prepared by dispersing the 70 wt.% of platinum supported carbon powder and 30 wt.% of a Teflon emulsion (Teflon 30) in a large volume of water, coagulating the resulting dilute emulsion of Teflon and carbon by addition of aluminum nitrate, and filtering the resulting coagulate to prepare a thin filter cake containing the catalyzed carbon and Teflon particles. This cake was dried, cold pressed onto the porous substrate, and finally hot pressed to bond the structure and provide mechanical strength by sintering the Teflon particles. The porous anode was mounted in a half cell containing an electrolyte composed of 8% copper sulfate and 4.6% sulfuric acid at room temperature, with the cathodic surface in contact with the electrolyte. Hydrogen gas was fed to the catalytic anode side of the electrode at a rate sufficient to provide a constant pressure in the gas feed chamber. The resultant current was monitored by an ammeter 13 mounted between the electrode and the cathode. No external voltage was provided. After 25 hours, no decrease in performance of a hydrogen electrode was noted as monitored by the current passing between the two electrodes. The current measured in the external circuit during the experiment was about 33 ma/cm$^2$. The weight of copper deposited on the cathode 11 gave a current efficiency of 100% within experimental error. The amount of copper deposited on the cathode surface of the porous nickel was approximately twice that deposited on the cathode 11, indicating that the total hydrogen consumption during the experiment was equivalent to 100 ma/cm$^2$.

Microscopic examination of the electrode 10 showed almost no copper present in the pores of the porous substrate, thereby indicating that the current density was sufficiently high so that copper ion was depleted very near the surface of the porous substrate and that no deposition, or substantially no deposition, took place within the porous nickel and near the catalyst. Also, it was determined at the end of the run that the copper deposit on the porous nickel surface was about 3 mm thick and that the porosity of the deposit was sufficiently high to cause no limitation of electrolyte access to the platinum surface.

EXAMPLE 2

The procedure outlined in Example 1 was followed, except that after 30 hours, the estimated current density was determined to be 119 ma/cm$^2$ and the copper solution was more than 85% consumed. Again, without noticeable decrease in hydrogen electrode activity. Microscopic examination again showed only traces of copper deposition in the pores of the nickel and none in the anode catalyst layer.

As should be appreciated, broad latitude and modification and substitution is intended in the foregoing disclosure. Accordingly, it is appropriate that the appended claims be construed broadly and in a manner consistent with the spirit and scope of the invention described herein.

What is claimed is:

1. A process for recovery of metals of oxidation potential below hydrogen from acid solutions thereof comprising:

providing a porous electrically conducting substrate having a first surface and a second surface, said substrate having a porosity such that under conditions of use the current density is sufficiently high that metal ions will be depleted near said second surface, providing an active hydrogen ionizing catalyst solely in contact with said first surface of said substrate;

contacting said second surface with said acid solution while feeding a fuel to said first surface whereby electric current is generated and metal is deposited from said solution on said second surface.

2. The method of claim 1 wherein said porous substrate has pores ranging in size from about 1 to about 100 microns in diameter.

3. The method of claim 2 wherein said solution is a copper sulfate solution.

4. A structure for the spontaneous deposition of metals of oxidation potential below hydrogen from aqueous acidic solutions thereof comprising:

an electrically conductive porous substrate having a first surface for contact with a fuel and a second surface for contact with an acidic metal solution, said substrate having a fuel activating metal catalyst solely on the first surface thereof, the porosity of said substrate being sufficient so that under conditions of use the current density is sufficiently high to deplete metal ions near said second surface, whereby the metal is deposited on said second surface and not deposited within the pores of the substrate.

5. The electrode of claim 4 wherein said porous substrate has pores ranging from about 1 micron to about 100 microns in diameter.

6. The electrode of claim 5 wherein said porous substrate has pores ranging from about 10 to about 50 microns in diameter.

7. The electrode of claim 6 wherein said metal catalyst is supported on a carbon powder and is bonded to said first surface in a sintered polymeric binder.

8. The electrode of claim 5 including a porous film of a polymeric mold release agent deposited on said second surface.

9. The electrode of claim 5 including plastic mesh detachably applied to said second surface.

* * * * *